United States Patent [19]

Fukuda

[11] 4,175,678

[45] Nov. 27, 1979

[54] EXPLOSION PROOF DEVICE FOR A PRESSURE ACCUMULATOR HAVING A VALVE PORTION

[76] Inventor: Motoo Fukuda, No. 522, 1305 To, 3-1, Shiomi-Dai, Isogo-Ku, Yokohama-Shi, Kanagawa-Ken, Japan

[21] Appl. No.: 794,601

[22] Filed: May 6, 1977

[30] Foreign Application Priority Data

May 7, 1976 [JP] Japan ..... 51-51274

[51] Int. Cl.[2] ..... B65D 83/14

[52] U.S. Cl. ..... 222/54; 222/396; 236/101 E

[58] Field of Search ..... 73/363.5; 236/93 R, 236/101 E; 220/367; 222/52, 54, 61, 396, 397

[56] References Cited

U.S. PATENT DOCUMENTS

| | | | |
|---|---|---|---|
| 2,494,079 | 1/1950 | Andrews | 236/101 E |
| 3,241,713 | 3/1966 | Clapp et al. | 222/396 X |
| 3,596,800 | 8/1971 | Iketani | 222/54 |
| 3,650,328 | 3/1972 | Fujiki et al. | 222/54 X |
| 3,680,738 | 8/1972 | Dean et al. | 222/54 |

*Primary Examiner*—David A. Scherbel
*Attorney, Agent, or Firm*—Oblon, Fisher, Spivak, McClelland & Maier

[57] ABSTRACT

An explosion proof device for a pressure accumulator, such as an aerosol container, having a valve portion comprising an action segment fixed in the vicinity of the valve portion, a part of such action segment being set in the state wherein engagement with a valve of the valve portion occurs, whereby the action segment can open the valve of the valve portion intermittently or permanently by displacement of the valve portion and/or of the action segment itself, being caused by the temperature of the atmosphere in which the aerosol container is disposed.

3 Claims, 13 Drawing Figures

EXPLOSION PROOF DEVICE FOR A PRESSURE ACCUMULATOR HAVING A VALVE PORTION

BACKGROUND OF THE INVENTION

1. Field of the Invention

The present invention relates to an explosion proof device for a pressure accumulator having a valve portion.

2. Description of the Prior Art

Pressure accumulators having a valve portion, such as an aerosol container, a bottle for a lighter, a bottle for fuel, a gas lighter, an autoclave, and a fire extinguisher, are apt to explode according to the conditions of the atmosphere in which they are put, especially according to the conditions of temperature. The explosion is very dangerous. Now, as a typical example of a pressure accumulator having a valve portion, an aerosol container is explained. It is very dangerous to throw away an aerosol container after use thereof into fire, to put an aerosol container under use in a place of high temperature for storage, or to set an aerosol container near fire, for in the above described conditions, the aerosol container explodes. Of course, an aerosol container under use is filled with gas and an aerosol container after use is still filled with gas. Therefore, when the specialist who deals with an aerosol container throws away the aerosol container, he drills it without generating sparks. However, a special technique is required to drill an aerosol container without generating sparks between the drill and the wall of the aerosol container prepared with such a device to enable throwing away with safety, wherein a push button device thereof is made to be permanently pressed downwards, and thereby the gas in the aerosol container is exhausted. However, this type of aerosol container, with a push button device to be pushed down, forces a user to do such troublesome work as described above before he throws it away and if he forgets to push down the push button device and throws it away, there is a danger of explosion. These are the defects of an ordinary aerosol container.

SUMMARY OF THE INVENTION

The object of the present invention is to provide an explosion proof device for a pressure accumulator having a valve portion that has a very simple composition and does not explode even if it is kept by such a fault keeping method as to put it on a place of high temperature or if it is thrown away into fire.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein.

Figure 1:
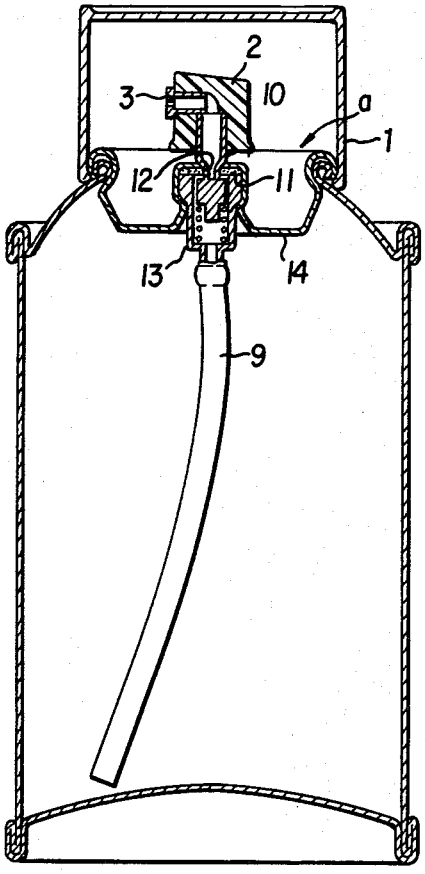
FIG. 1 PRIOR ART
FIG. 1 is a longitudinal sectional front view of one embodiment of ordinary aerosol containers.

In the drawings, the letter b denotes a valve portion, the letter C denotes an action segment and the numeral 10 denotes a valve, respectively.

DESCRIPTION OF THE ILLUSTRATED EMBODIMENTS

With respect to the composition of the valve portion of a pressure accumulator having a valve portion, there are various types. In this specification, as an example, an aerosol container which has comparatively many types is explained.

Some types of valve portion and the function thereof are explained as follows. This valve portion is a portion that is equipped with a valve to exhaust gas and materials contained in the pressure accumulator or a valve to fill the pressure accumulator with gas. Besides, the concrete meaning of the valve portion will be described later.

The first type of ordinary prior art aerosol container to be described is the "downward pushing type".

As shown in FIG. 1, a cap 1 is removed and an injection push-button 2 is pushed downwards, thereby a valve 10 pushing a gasket 11 downwards and opening the inlet of an opening 12 of the valve 10 situated in contact with the inner surface of the gasket 11. Therefore, the gas and the materials included in the aerosol container are exhausted from an injection nozzle 3 via an inner portion of the valve 10 through opening 12 from a valve box 13 and a guide pipe 9.

A covering means 14 supported thereon the push button 2, the valve 10 and the valve box 13, and so on, is called a mountain cup a in the following description. Not only a mountain cup a, but also a valve 10 and a valve box 13 (Refer to FIG. 4) from which gas is filled into the aerosol container are all referred to as a valve portion b.

The second type of ordinary prior art aerosol container to be described herein is the "bringing down type".

This second type is explained in accordance with FIG. 2-A, which shows one embodiment of the present invention. First, a cap 1 is removed and an injection push-button 2 is brought down by force in the direction of an arrow P, as shown in FIG. 2-B. Thereby, a valve 10 is inclined against a coil spring 21 and some part of the valve face departs from the gasket 11. Therefore, the gas and the materials included in the aerosol container are exhausted from an injection nozzle 3 via the inner portion of valve 10 through opening 12 of valve 10 from valve box 13 and a guide pipe 9.

The third type of ordinary prior art aerosol container to be described is the "valve immersion type" wherein the valve is pushed downwards.

Figure 3A:
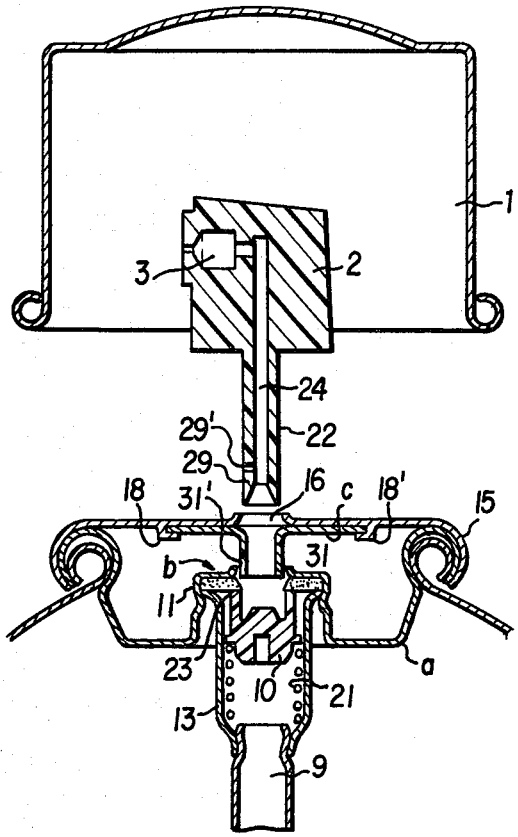
FIG. 3 is an explanatory view of the principal part of another embodiment of the present invention applied to an ordinary aerosol container of the "valve immersion type" by pushing the valve downwards, wherein FIG. 3-A is an explanatory exploded view thereof in FIG. 3-B is a plan view of another embodiment of the action segment C.
Figure 3B:
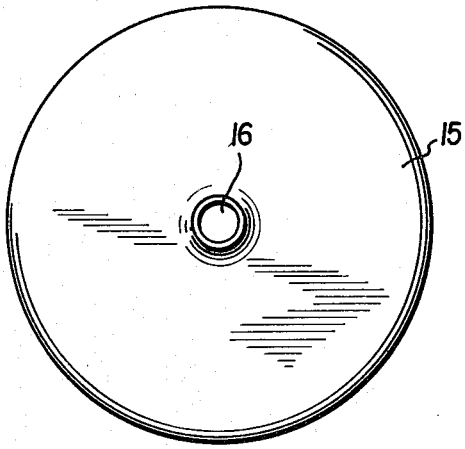

This third type is explained in accordance with FIG. 3 which shows another embodiment of the present invention. First, a cap 1 is removed and an injection push-button 2 is pushed downwards, thereby a hollow pushing bar 22, elongated from the under surface of the push-button 2, being pressed into contact with a gasket 11 by the action of a coil spring 21, causes a space 23 to arise between the valve 10 and the gasket 11 by the downward displacement of the valve 10, immersed wholly in a valve box 13, which is forced to move downwards by the hollow pushing bar 22. Therefore, the gas and the materials in the aerosol container are exhausted from an injection nozzle 3 through a hollow portion 24 after passing a slit 29 in the hollow pushing bar 22 and the space 23 between the gasket 11 and the valve 10 from the valve box 13 and a guide pipe 9.

The fourth type of ordinary aerosol container is a type of separated form called the "cepro type".

Figure 4A:
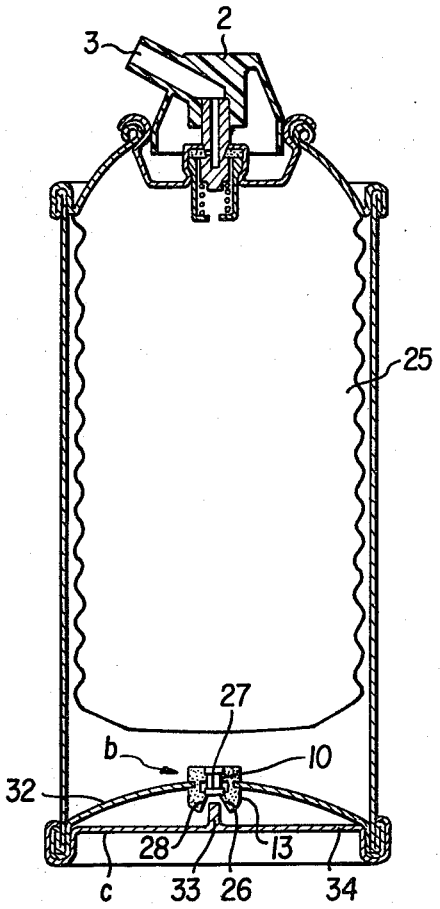
FIG. 4-A is a longitudinal sectional view of a further embodiment of the present invention applied to an ordinary aerosol container of the "cepro" type and FIG. 4-B is a perspective view of a piece of the inner parts of the valve.
Figure 4B:
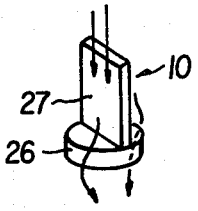
Figure 2A:
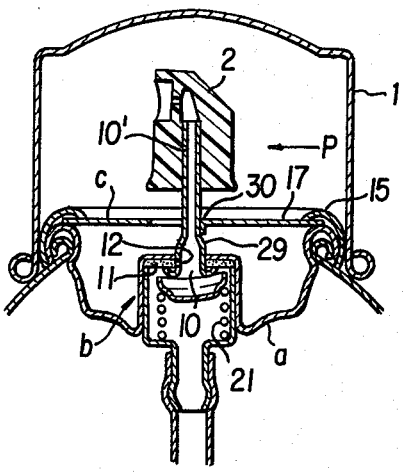
FIG. 2 is an explanatory view of the principal part of one embodiment of the present invention applied to an ordinary prior art aerosol container of the "bringing down type", wherein FIG. 2-A is a sectional view of the principal part, FIG. 2-B is a sectional view to show the action segment C in operation, FIG. 2-C is a plan view of the action segment C, FIG. 2-D is a longitudinal sectional view of another embodiment of the action segment C and FIG. 2-E is a plan view thereof.
Figure 2B:
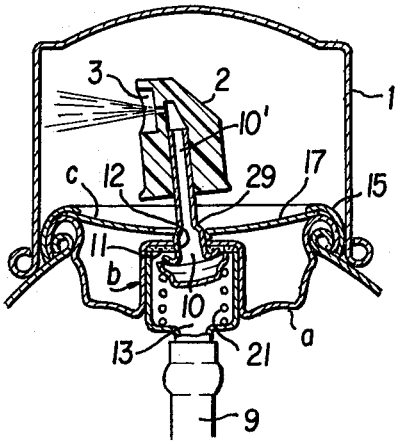
Figure 2C:
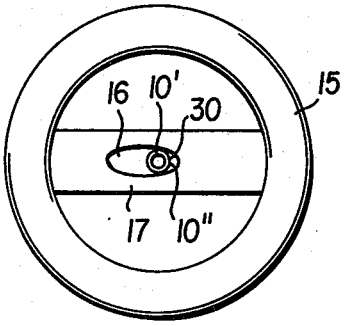
Figure 2D:
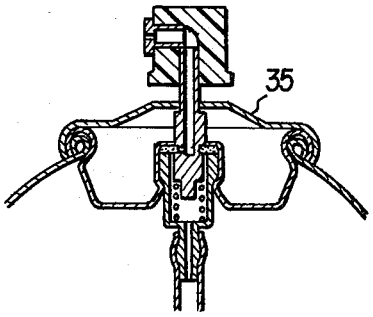
Figure 2E:
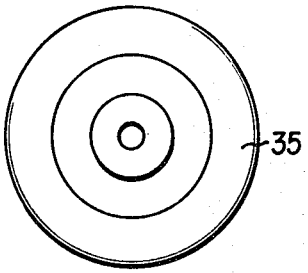

This type is explained in accordance with FIG. 4 which shows yet another embodiment of the present invention. In this type, the materials contained in a pressure accumulator are separated from the gas, such materials being contained in a bellows room 25. An injection nozzle 3 is in the push button device, as shown in FIG. 1. When the push-button device 2 is pushed down, the gas is exhausted from the nozzle 3. At the bottom of the container, is set a valve box 13, made of rubber, in which is formed a valve 10 having a vertical wall 27 projecting from a bottom plate 26 of the valve 10, the bottom plate 26 having a valve portion which is used to fill gas in the container and is forced to be always in pressure contact with a part 28 of the valve box 13 by the elastic force of the valve box 13 made of rubber. When a user throws away the aerosol container after use, the work he must do is to push the bottom plate 26 upwards by a bar like projection. Then, a space is formed between the bottom plate 26 and the part 28 of the valve box and the gas is exhausted as shown in FIG. 4-B through both sides of the vertical wall 27 and the space.

Figure 5A:
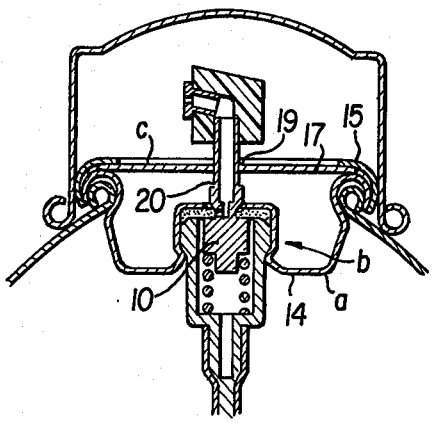
FIG. 5 is a view of other embodiment of the present invention applied to an ordinary aerosol container of the "downward pushing type", wherein FIG. 5-A is a sectional view of the principal part thereof in ordinary state, FIG. 5-B is a longitudinal sectional front view of the other embodiment of the action segment C in operation and FIG. 5-C is a plan view thereof.
Figure 5B:
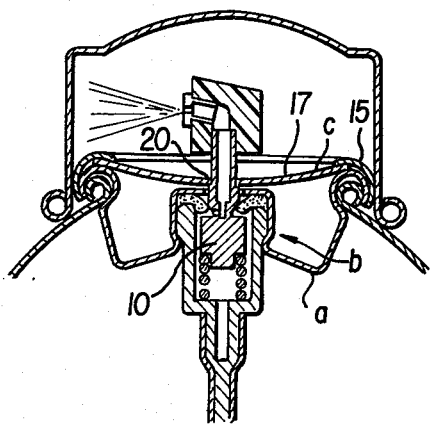
Figure 5C:
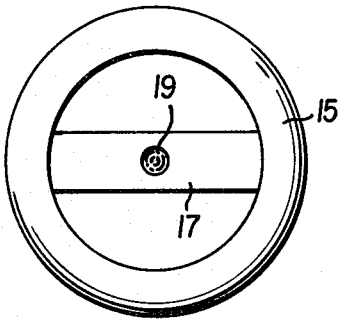

The present invention then relates to an explosion proof device for a pressure accumulator having a valve portion that can be applied not only to the aerosol containers which are described above, but also to a pressure accumulator having a valve portion before described. First, the composition of the present invention is explained in accordance with an embodiment of the present invention applied to the first type which is the "downward pushing type", as shown in FIG. 5-A. A bimetallic plate 17 is sustained as an action segment C by a cover 15 of a ring form which is covered over the edge of a mountain cup a between the cover 15 and the edge of the mountain cup a. The bimetallic plate 17 has a through opening 19 by which it can engage with a step portion 20 especially formed on the side portion of the valve 10. In other words, the action segment C is fixed in the vicinity of the valve portion b of an aerosol container and a part of the action segment C is engaged with the valve portion b.

As this embodiment, as shown in FIG. 5-A, has the above described composition, if the gas and the materials included in the aerosol container are all used and the aerosol container is thrown away into fire after use with a cap 1 thereon, the temperature in the cap 1 becomes high rapidly and the bimetallic plate 17 begins to act. In this case, if the bimetallic plate 17 is composed to become convex to the side of the mountain cup a, the bimetallic plate 17 pushes down the valve 10 and the gas is exhausted, as shown in FIG. 5-B, as the bimetallic plate 17 is formed to engage with the step portion 20 of the valve 10. By this exhaustion, the temperature in the cap 1 becomes low rapidly and the bimetallic plate 17 comes back to the original state thereof, to stop the action of the bimetallic plate 17, which forces the valve 10 to go down. Then, when the temperature in the cap 1 becomes high again, the bimetallic plate 17 again pushes down the valve 10 and the gas is exhausted, the bimetallic plate 17 repeating these actions and the gas being intermittently exhausted. The gas is exhausted into the cap 1, is further exhausted from the cap 1 to the outside thereof through openings drilled in the cap 1.

Besides, if the temperature of the atmosphere is high, the pressure in the container becomes high and the covering means 14 of the mountain cup a bulges outwards, and the valve 10 itself pushes the bimetallic plate 17 upwards by the step portion 20 and by the reaction, the valve 10 is forced to go downwards, thereby the gas in the container being exhausted.

In the above case, where the bimetallic plate 17 is used as an action segment C, the intermittent exhaustion, as described above, is repeated. However, instead of the bimetallic plate 17, an iron plate is used, only when the mountain cap a is bulged, the valve 10 is pushed down for the first time and is made to open permanently.

Besides, in the above case, the action segment C is sustained between the covering means 15 and the mountain cup a and is situated in the vicinity of the valve portion b of the aerosol container in the fixed state, to which the present invention is not limited. As shown in FIG. 2-D, the cover 15 and the action segment C may be made in a body which is like a flat cap state, as denoted by reference numeral 35 in the FIG. 2-D, the composition thereof being very simple and the cost to make it being very low. Further, as shown in FIG. 3, on the under side of the cover 15, a tongue piece 18, 18' may be projected, on which the edges of the action segment C may be fixed respectively.

Next, the composition of the present invention is explained in accordance with an embodiment of the present invention applied to the second type, which is the "bringing down type", as shown in FIG. 2. In the bimetallic plate 17, which is an action segment C sustained between a covering 15 and the edges of the mountain cup, a is drilled an oval opening 16, which is elongated to one side from the center of the action segment C, as shown in FIG. 2-C, and on the vertical side of the valve 10 is formed an inclined surface 29, so that the one side edge 30 of the oval opening 16, which is the center of the action segment C, can be in contact with the generatrix 10'', which is that of the one side of the valve stem 10' of the valve 10, as shown in FIG. 2-C.

As the embodiment of the "bringing down type", described above, has the above mentioned composition, if the temperature in the cap 1 becomes high and the bimetallic plate 17 acts and bulges to the side of a valve box 13, as shown in FIG. 2-B, one edge side 30 of the oval opening 16 of the bimetallic plate 17 begins to engage with the inclined surface 29 of the valve stem 10' of the valve 10 and the valve 10 inclines according to the valve stem 10', thereby the gas and the materials in the container are exhausted from an injection nozzle 3. Besides, in the case where a bimetallic plate is used as an action segment C and in the case where an ordinary iron plate is used as an action segment C, the functions and the effects are the same as those in the case of the "pushing down type".

Third, the composition of the present invention is explained in accordance with an embodiment of the present invention, applied to the third type, which is the "valve immersion type", by pushing the valve downwards, as shown in FIG. 3.

On the under surface of a cover 15, having a through opening 16 at the center thereof and covering a mountain cup a for the "valve immersion type" are projected tongue pieces 18, 18', by which an action segment C made of a bimetallic plate or an iron plate having a projected long hollow cylinder 31 is formed at the center of the action segment C to engage with a valve 10. Besides, at the tip of the projected long hollow cylinder is drilled a slit 31'.

As the embodiment of the third case, applied to the "valve immersion type" by pushing the valve downwards, has the composition described above, the bimetallic plate 17 acts when the temperature in the cap 1 becomes high, and the projected long hollow cylinder 31 enters into the valve 10 and pushes down the valve 10, and thereby the gas and the materials included in the container are exhausted from the injection nozzle 3 through a space between the valve 10 and the gasket 11, the slit 31' of the projected long hollow cylinder, a slit 29' of a hollow pushing bar 22, and a hollow portion 24 of a hollow pushing bar 22. Besides, in the case where a bimetal is used as an action segment and in the case where an ordinary iron plate is used as an action segment, the functions and the effects thereof are the same as those of the "downward pushing type" and the "bringing down type".

Fourth, the composition of the present invention is explained, in accordance with an embodiment of the present invention applied to the fourth type, which is the separated form called "cepro type", as shown in FIG. 4. In front of a gas enclosure portion b, mounted at the center of a concave mirror type bottom plate 32 at the bottom portion of an aerosol container, is situated an action segment C having a thin stem 33, vertically mounted at the center portion of the circular plate 34, which can cover on the periphery edge of the bottom plate 32, the thin stem being able to engage with the valve 10 of valve portion b at the center thereof and to actuate the valve 10. Besides, in the circular plate 34 is drilled at least one opening, thereby the gas being able to go outwards.

As this embodiment of the present invention, applied to the so called "cepro type", has the composition described above, if the temperature of the atmosphere into which the aerosol container of the "cepro type" is thrown away, is high, the container bulges outwards due to the increased internal pressure and the bottom plate 32 bulges outwards too, thereby the thin stem 33 pushes upwards the valve 10 of the valve portion b with certainty, a space arises between the bottom plate 26 of the valve 10 and the part 28 of the valve box 13 and the gas flows outwards, as denoted by an arrow in the FIG. 4-B.

The compositions and the functions of some embodiments of the present invention are explained respectively in the above description and as the present invention has the composition and the functions as described above to show the essence thereof, if the action segment is made of a metal plate, such as iron or steel, when the aerosol container according to the present invention is put near fire or is thrown away into fire or is kept for a long time in the atmosphere of high temperature, the aerosol containers bulge outwards due to the increased internal pressure, thereby the valve 10 of the valve portion b is permanently opened independently of the existence of the cap and the explosion of the aerosol container is able to be prevented. If the action segment is made of a bimetallic plate, only the bimetallic plate deforms by high temperature, and thereby the valve of the valve portion is opened only when the temperature is high.

Besides, in the case where a bimetallic plate is used as an action segment, when an aerosol container is thrown away with a cap thereon, there arises special effects as described below.

That is to say, by the temperature of fire, the bimetallic plate deforms in the cap 1 and actuates the valve 10 of the valve portion, whereby the gas is exhausted into the cap 1 and the temperature in the cap 1 becomes low, and then the deformation of the bimetallic plate disappears. Therefore, the bimetal does not push the valve and the exhaustion of the gas is stopped. However, as the temperature in the cap increases in degrees at once, the bimetallic plate deforms again and pushes the valve 10 down again. These actions are repeated and the gas in the container is exhausted intermittently.

The above described intermittent gas exhaustion prevents unexpected accidents almost completely wherein the aerosol container flies like a rocket by the reaction of the exhaustion of the gas at a brush or the gas begins to burn by the action of fire or the fire force is more enforced. Further, it prolongs the time to explosion and provides a chance to correct a faulty treatment rapidly. Besides if the explosion proof device, in accordance with the present invention is applied to an aerosol container, as there is no fire in the device thereof, there is no fear to be liable to combustion. Further, such other troubles are prevented almost completely, such as making the atmosphere dirty by the exhaustion of the included materials in the container or the explosion of the container. Besides, the embodiments, in accordance with the present invention, above described, were all explained by the aid of the aerosol containers. However, the present invention is not limited to aerosol containers, but it can be applied to any pressure accumulator with a valve portion as an explosion proof device therefor.

What is claimed as new and desired to be secured by Letters Patent of the United States is:

1. In a pressure accumulator having a valve member adapted to be opened for exhausting gas and other materials from said accumulator by movement of said valve member in a given direction against a biasing force tending to maintain said valve in a closed position, the improvement comprising:

means disposed between said accumulator and said valve member, being responsive to heat of a predetermined degree, for automatically operating said valve member to open said valve for exhausting gas and other material from said accumulator, said means for operating said valve member comprising a bimetallic plate having an opening therethrough for receiving said valve member.

2. A pressure accumulator as set forth in claim 1, wherein said bimetallic plate means for operating said valve member is intermittently operable, according to increasing and decreasing temperatures.

3. A pressure accumulator as set forth in claim 1, wherein said means for operating said valve member and being responsive to heat comprises a metal plate having an opening therethrough for receiving said valve member and is operative to permanently open said valve member.

* * * * *